United States Patent [19]

McManus

[11] Patent Number: 4,736,971

[45] Date of Patent: Apr. 12, 1988

[54] BILLET GRAB

[75] Inventor: James P. McManus, Spokane, Wash.

[73] Assignee: Acme Machine Works, Inc., Spokane, Wash.

[21] Appl. No.: 931,426

[22] Filed: Nov. 14, 1986

[51] Int. Cl.[4] ..... B66C 1/28

[52] U.S. Cl. ..... 294/87.1; 294/88; 294/99.2; 294/119.1; 294/67.33; 294/81.54; 294/902

[58] Field of Search ..... 294/87.1, 88, 86.4, 294/99.1, 902, 903, 104, 81.21, 81.54, 67.3, 67.31, 67.33, 81.51, 81.56, 81.61, 81.62, 119.1

[56] References Cited

U.S. PATENT DOCUMENTS

| | | | |
|---|---|---|---|
| Re. 23,694 | 8/1953 | Ehmann . | |
| 1,039,727 | 10/1912 | Gilmartin . | |
| 1,760,885 | 6/1930 | Prelesnik . | |
| 2,066,625 | 1/1937 | Howard et al. . | |
| 2,486,324 | 10/1949 | Rike . | |
| 2,647,007 | 7/1953 | Gmoser et al. . | |
| 2,853,335 | 9/1958 | Mogle . | |
| 2,872,050 | 2/1959 | Norwood . | |
| 3,074,753 | 1/1963 | Gardner . | |
| 3,088,505 | 5/1963 | Pearson . | |
| 3,659,890 | 5/1972 | Renfroe . | |
| 4,113,298 | 9/1978 | Kopp . | |
| 4,162,804 | 7/1979 | Davies . | |
| 4,261,609 | 4/1981 | Kraszewski et al. . | |
| 4,327,944 | 5/1982 | Langloy . | |
| 4,422,487 | 12/1983 | McCurdy . | |
| 4,498,699 | 2/1985 | Davies . | |
| 4,557,371 | 12/1985 | Yonezawa | 294/87.1 |
| 4,563,031 | 1/1986 | Kishimoto et al. | 294/87.1 |

*Primary Examiner*—James B. Marbert

*Attorney, Agent, or Firm*—Wells, St. John & Roberts

[57] ABSTRACT

A billet grab includes opposed grips that are movable toward or away from one another in a direction perpendicular to their lengths. One grip is provided with a plurality of identical cams pivotally mounted on it to engage the ends of billets or other objects having identical or slightly varying lengths and arranged side by side in a row. The inwardly biased cams accommodate the varying lengths of the billets or objects, which can then be lifted as a group. Frictional engagement between the inner cam surfaces and the ends of the billets or other objects assure proper gripping of each billet or object in the row as it is being lifted and handled. The cams are disengaged by spreading the grips apart from one another.

18 Claims, 4 Drawing Sheets

12
11
11
13
13
17
15
14
20
22
24
21
33
23
23
25
29
25
29
33
30
28
26
34
42
32
42
32
10
36
28
36

BILLET GRAB

TECHNICAL FIELD

This invention relates to a billet grab for lifting and stacking metal billets.

BACKGROUND OF THE INVENTION

Refined metal, which is usually in molten form after an initial separation process, is cast into ingots or billets as an intermediate operation between the smelting and further treatment of the metal. In the aluminum industry, the metal is normally formed into billets which are generally cylindrical in shape, and sawed to desired lengths depending upon the requirements of further processing steps, such as extruding or rolling. Cylindrical aluminum billets typically have diameters ranging from 6 inches up to 20 inches. The nominal length of aluminum billets also varies widely, normally between 16 inches to 36 inches. In many cases the billets which have been produced by a particular metal processing plant are shipped to a different location for further processing. In order to ship and handle the billets they must be lifted, preferably in groups or rows, to facilitate storage and stacking procedures.

In the aluminum industry numerous billets are cast and cut at one time and it is desirable to have a billet grab which can lift and move a number of billets at one time. Due to the way they are formed to length, normally by cutting, the billets might have identical or slightly varying lengths. Since the cut billets are usually arranged side by side in a row, it is desirable to have a billet grab which can automatically adjust for differing individual billet lengths in each row.

One example of a billet lifting device is U.S. Pat. No. 2,647,007 to C. H. Gmoser. The Gmoser patent discloses an adjustable lifting clamp for lifting a single metal ingot or billet. The lifting clamp must be manually positioned with the ends of the clamp on opposite sides of the billet. One end of the clamp is then manually adjusted until both sides of the clamp are engaged with opposite sides of the billet. One end of the clamp has a pivotally mounted cam which, through direct mechanical linkage with the lifting shackle on the clamp is pivoted and forced into the end of the billet. As the billet is lifted, the lifting action on the shackle of the lifting clamp forces the cam further into the side of the billet until the billet is firmly held between the jaws of the lifting clamp. The Gmoser clamp is suitable only to lift a single billet, and is not adaptable to lift a number of billets at one time. In addition, the Gmoser clamp must be manually positioned over the billet to be lifted and the movable jaw must be manually positioned so that both jaws of the lifting clamp are in engagement with the billet. The cammed billet engaging surface on one jaw is mechanically driven through a direct mechanical connection with the lifting clamp.

Another prior art billet grab is shown in U.S. Pat. No. 4,261,609 to Kraszewski. The Kraszewski patent discloses an ingot grab apparatus having a pair of grab legs supported for horizontal movement toward and away from one another. Each of the grab legs has a grip point mounted on the leg for movement along an incline which extends downwardly and inwardly and upwardly and outwardly. The grip points on each grab leg face one another for engagement with side surfaces or opposite ends of an ingot. When the legs are moved toward one another, the points engage opposite sides or ends of the ingot. As the carrier is elevated and the grip points bear the weight of the ingot, the grip points are forced downwardly and inwardly into the ingot for secure lifting engagement. The lift points in the Kraszewski ingot grab are biased into their upward position by a spring when an ingot is not engaged between the legs. Once the grip points are engaged and are carrying the weight of the ingot, a spring-loaded locking device moves outwardly and prevents any upward movement of the grab points when the ingot is lifted. The Kraszewski ingot grab is suitable only for lifting one ingot at a time, since the grab points are biased upwardly when they are not engaged, and a shorter ingot in a row of ingots would not be engaged by the grip point, and therefore would not be lifted by the ingot grab.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

The instant invention arose out of the need to design a billet grab which could simultaneously lift a number of metal billets 10 arranged side-by-side in a row, with the billets 10 having identical or slightly varying lengths. It can automatically adjust to the differing lengths, and can handle billets 10 of widely varying diameters and different cross-sectional shapes.

While the direct object of this disclosure is to describe a billet grab for cylindrical aluminum billets, it is to be understood that the apparatus is equally applicable to lifting of any grouped objects arranged side-by-side in a row and having identical or slightly varying lengths. Therefore, specific references to the billets described herein are to be interpreted to encompass all such objects, whether pertaining to the metals industry or not.

Figure 1:
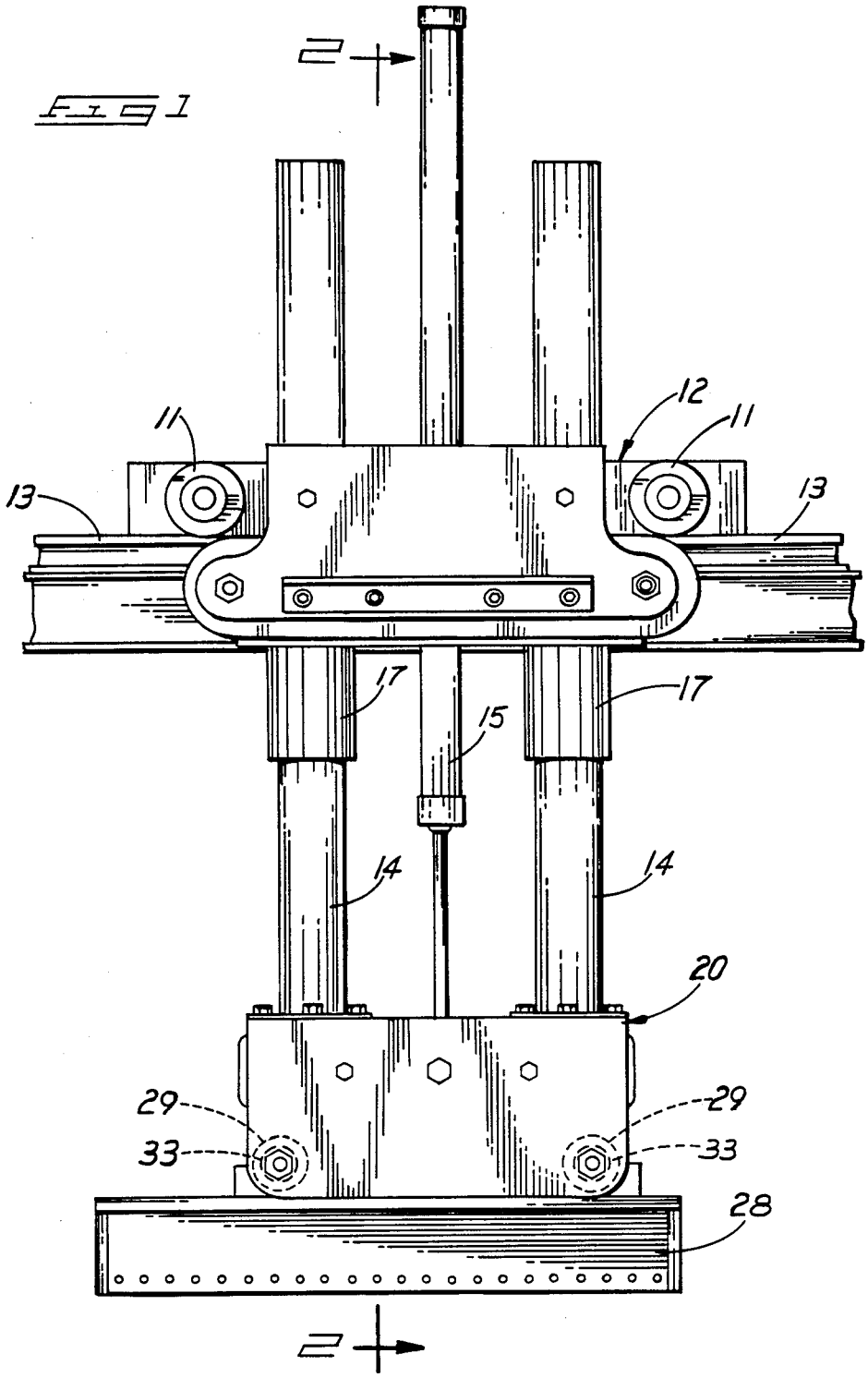
FIG. 1 is an elevation view of the billet grab.
Figure 2:
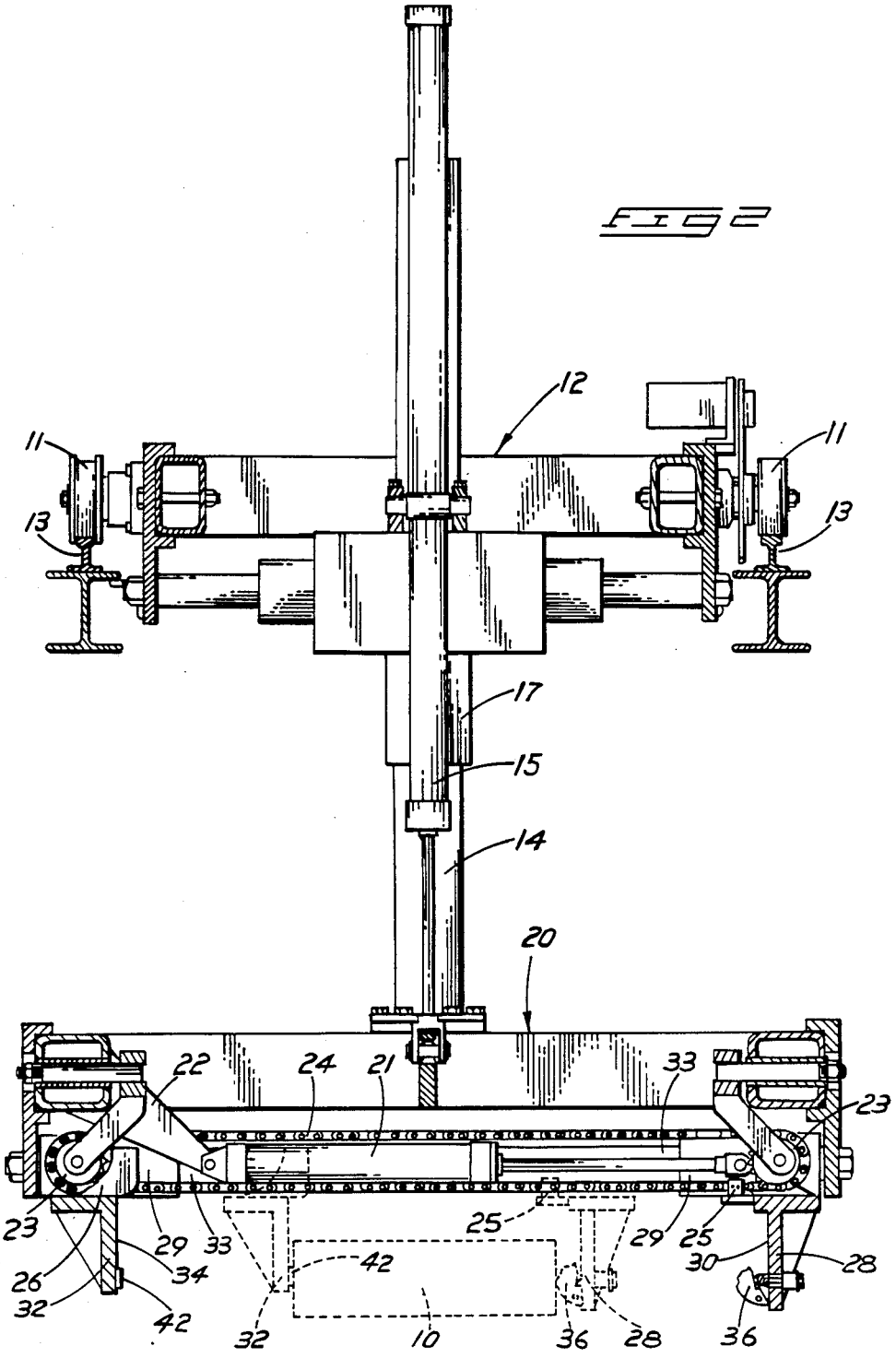
FIG. 2 is a cross-sectional view of the billet grab along line 2—2 of FIG. 1.

The preferred embodiment of the billet grab is illustrated in FIGS. 1 and 2. The billet grab includes a movable carriage 12. In the preferred embodiment the movable carriage 12 is supported on a pair of overhead rails 13 by powered wheels 11.

A support frame 20 is attached to the movable carriage 12 and is located vertically downward from it. In the preferred embodiment as shown in FIGS. 1 and 2, the support frame 20 is hydraulically powered for vertical movement by a cylinder assembly 15 operably connected between support frame 20 and carriage 12. Vertical motion of support frame 20 is guided on carriage 12 by two vertically oriented stabilizer shafts 14 that extended upwardly from it and slide within guide bushings 17 along the center line of the movable carriage 12.

Attached to the bottom of the support frame 20 are a first elongated grip 28 and a second elongated grip 32. First and second grips 28 and 32 are mounted parallel to one another. The first and second grips 28 and 32 include opposed inner surfaces 30 and 34, respectively.

The first and second grip members 28 and 32 include guide bushings 29 which slide along fixed guide shafts 33 fixed transversely across the support frame 20.

The pair of elongated grips 28 and 32 are mounted on support frame 20 by bushings 29 and shafts 33 for relative motion toward or away from one another in a direction perpendicular to their lengths. In order to permit the apparatus to lift a row of billets without substantially shifting the billets endwise, both grips 28 and 32 are preferably moved relative to one another in equal and opposite directions. As can be seen in FIG. 2, this can be accomplished by connecting grip 28 to one end of an extensible hydraulic cylinder assembly 21. The opposite end of cylinder assembly 21 is anchored to support frame 20 by means of a fixed bracket 22. Support frame 20 also rotatably carries a pair of aligned sprockets 23 having an endless roller chain 24 entrained about them. The first grip 28 is attached to the lower flight of chain 24 by a clamp shown at 25. The second grip 32 is similarly attached to the upper flight of chain 24 by a clamp 26. Thus, movement imparted to the first grip 28 by actuation of the reversible hydraulic cylinder assembly 21 will impart equal and opposite movement to the second grip 32 through the resulting movement of the endless connecting chain 24.

The inner surface 30 of the first grip 28 is provided with a plurality of identical cams 36 pivotally mounted about an axis parallel to its length. The cams 36 are spaced apart along the length of the grip 28. Each is individually biased to an extended position spaced inwardly from the inner surface 30, which is illustrated in full lines in FIG. 3. Each cam 36 is individually movable toward the inner surface 30 about its axis in response to engagement of the cam 36 against one end of a billet or other object. The fully retracted position of cam 36 is shown in dashed lines in FIG. 3. The retractable nature of cams 36 permits them to individually adapt to billets of slightly varying length arranged side by side in rows between the two grips 28 and 32.

Figure 5:
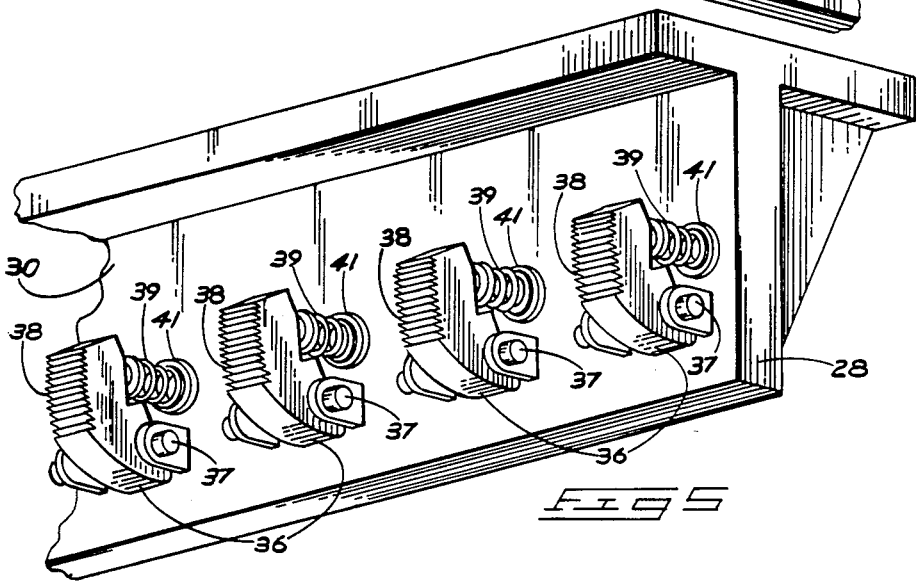
FIG. 5 is an enlarged partial perspective view of the remaining grip.
Figure 6:
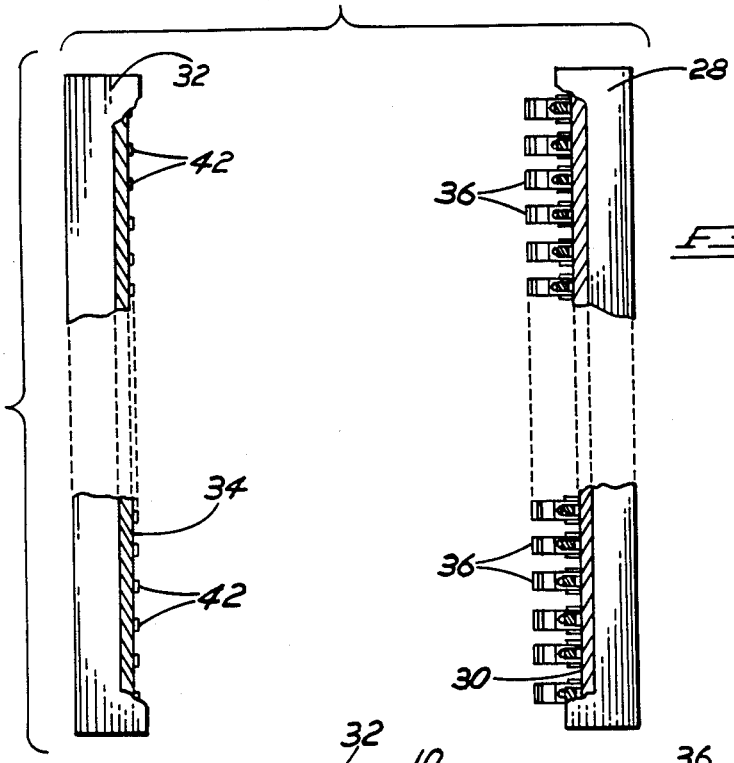
FIG. 6 is a schematic plan view showing a pair of opposed grips, portions of the grips being broken away.
Figure 7:
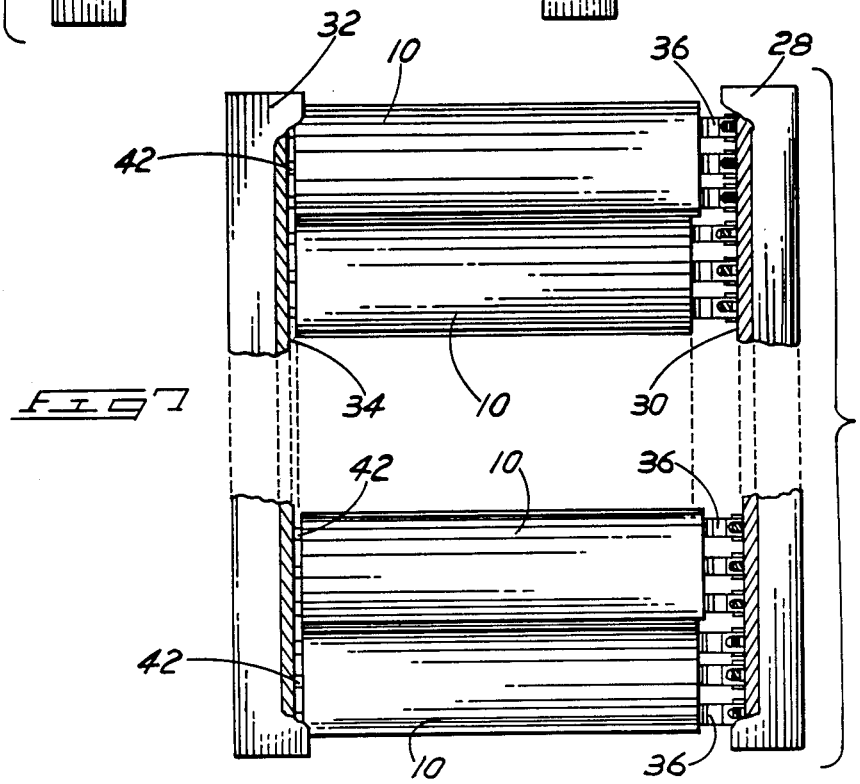
FIG. 7 is a similar schematic plan view showing the grips engaged with the ends of a series of billets.

As shown in FIG. 5, the individual cams 36 are pivotally mounted about the central axis of individual pivot shafts 37 mounted to the first grip 28. The shafts 37 can be coaxially aligned or can be staggered elevationally about the inner surface 30 of grip 28. When practical, a common shaft can mount the various cams 36 along the grip 28.

Each cam 36 includes an inwardly facing frictional surface 38 for engagement against one end of a billet 10. The surface 38 has an arcuate convex shape so that its position with respect to the inner surface of grip 28 will vary as a function of its angular position about the axis of shaft 37. The frictional surface 38 can be provided by facing the cam 36 with plastic, soft metal, or other materials having high coefficients of friction, or by physically scoring or serrating the surface as shown in the drawings. The important aspect of this feature is that the frictional surface 38 be capable of securely gripping the billets or other objects lifted between grips 28 and 32 as a function of the frictional engagement between the cams 36 and the ends of the billets 10.

Figure 3:
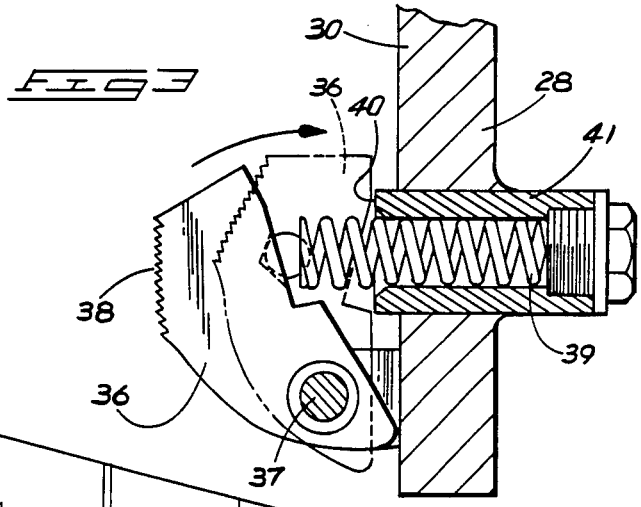
FIG. 3 is an enlarged cross-sectional vertical elevation view through a single cam assembly.
Figure 4:
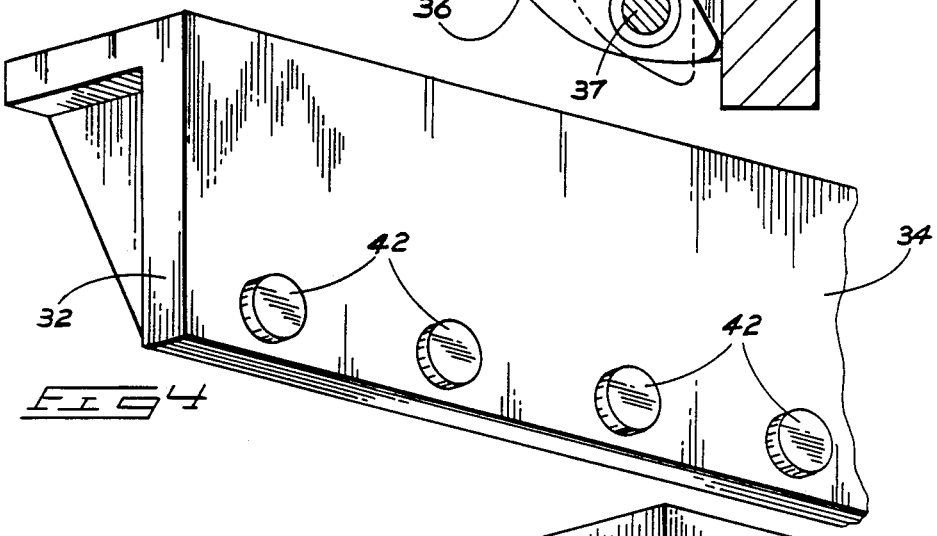
FIG. 4 is an enlarged partial perspective view of one of the grips.

As can be seen in FIG. 3, the cams 36 are preferably biased by gravity to their extended position inward from inner surface 30. This can be accomplished by locating the center of gravity of cam 36 inwardly of the pivotal axis through the supporting shaft 37. However, to assure inward biasing of each cam 36 and to provide a predetermined minimum initial frictional engagement between the cam surfaces 38 and the billet ends engaged by them, a compression spring 39 is located between grip 28 and each cam 36. The individual springs 39 yieldably bias the cams 36 to their extended positions, inward movement of each cam 36 being limited by abutment of a cam extension 40 against the adjacent inner surface 30. Spring 39 is encircled by a tube 41, which provides a seat for engagement by cam 36 when fully retracted about the axis of shaft 37, as shown in dashed lines in FIG. 3.

While both grips 28 and 32 can be provided with movable cams 36, the remaining grip 32 is typically provided with a plurality of identical frictional surfaces 42 that protrude inwardly from it in direct opposition to the individual cams 36. The frictional surfaces 42 on grip 32 are shown as protruding studs spaced equally along the length of the inner surface 34 and at an elevation equal to the elevation at which the billets are frictionally engaged by the inner surfaces 38 of the cams 36.

In operation, the movable carriage 12 is rolled along the rails 13 until support frame 20 is located above a row of billets which are to be lifted. Support frame 20 can then be lowered by actuation of cylinder assembly 15. Grips 28 and 32 are preferably elevationally positioned by cylinder assembly 15 to engage the ends of the billets across their diameters.

When positioned outwardly from the billets, grips 28 and 32 can be moved toward one another by operation of cylinder assembly 21. In order to accommodate slight variations in billet length, the cylinder 21 is operated until a predetermined pressure is applied between grips 28 and 32 through the cams 36 fully retracted and seated against tubes 41. However, where slightly shorter billets are engaged by one or more cams 36, these cams will be held inwardly against the billet end surfaces by the compression springs 39.

After engagement of the billets 10 at opposite ends, cylinder assembly 15 can be operated to raise the support frame 20. As they are lifted, the frictional forces between the billet ends and the pivotable cams 36 will urge cams 36 inwardly toward the billets, thereby increasing the end pressure against each billet and assuring its support between the grips 28 and 32, regardless of billet length variations.

After being moved or stacked, a row of billets can be released by spreading grips 28 and 32 apart. This is accomplished by operation of cylinder assembly 21. As grips 28 and 32 move outwardly from the billets, the cams 36 and frictional surfaces 42 will be automatically disengaged without further mechanical operation.

While this invention has been described with respect to handling of cylindrical billets such as are produced in the aluminum industry, it is to be understood that it is applicable to the lifting and stacking of any objects having identical or slightly varying lengths and arranged side by side in a row. The objects may have any cross section, including cylindrical, polygonal, ellipsoid, etc. They may vary from a nominal length in a dimensional range within the range of movement provided at frictional inner surface 38 on each cam with respect to inner surface 30.

The preferred embodiment of the invention shown in the drawings illustrates the invention as applied to grips that are linearly movable. It is to be understood that cams 36 can be arranged across other forms of grips to accommodate varying lengths of objects engaged as a group. For instance, the grips 28 and 32 might be pivotally interconnected to one another or to an interposed framework. The grips 28 and 30 need not be movable horizontally or vertically other than for purposes of engaging and disengaging relative to the ends of the objects being gripped. Where the grips are both provided with pivotable cams of the type illustrated on grip 28, the closing action of the cams themselves will slightly raise the objects from a support surface so that an alternate support surface can be placed beneath them. As an example, cylindrical billets might be rolled between the grips on retractable forks. The grips might then close endwise and slightly raise the billets from the forks due to the lifting engagement between the billet ends and the opposed cams. The forks might then be withdrawn from the raised billets and a packaging jig moved into their place to accept the gripped row of billets.

There are many possible variations in the design of cams 36. They can be individually biased inwardly from the supporting grips by individual compression springs, by gravity, or (as shown) by both. Furthermore, the compression spring might be replaced by individual leaf springs or a yieldable elastomer. The cam itself can be extended to provide a crank arm for engagement by a suitable biasing spring.

One final feature of the illustrated embodiment is its ability to grip individual billets or objects by at least two of the movable cams 36. This is accomplished by spacing cams 36 apart from one another along the length of grip 28 by a repetitive center-to-center distance that is less than the width of the individual billets or objects as measured across their areas of engagement by the cams. More specifically, in the case of cylindrical billets, the spacing between adjacent cams 36 is less than the diameter of the billets, assuming that the billets are to be gripped along their common diameters extending across the row of billets. Having the cams spaced by a distance less an the width of the billets or objects assures that each billet or object will be engaged by at least one cam. If a single cam overlaps more than one billet, that billet will be fully engaged by an adjacent cam.

To assure that each billet is engaged by at least two cams, it is preferable that the spacing between adjacent cams be approximately one third the width or diameter of the billets of objects. In a specific example of a lift designed for billet diameters ranging between 6 inches to 20 inches, the center-to-center spacing of the cams 36 is preferably two inches.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An apparatus for simultaneously grasping and lifting a plurality of elongated objects having identical or slightly varying lengths and arranged side by side in a row, the elongated objects having transverse ends that are solid across a substantial width of the objects, the apparatus comprising:

a pair of elongated grips positioned parallel to one another and mounted for relative motion toward or away from one another in a direction perpendicular to their lengths, the grips having opposed inner surfaces adapted to respectively face opposite transverse ends of the elongated objects; and the inner surface of at least one grip being provided with a plurality of identical cams pivotally mounted about an axis on the grip with the cams being spaced apart along the length of the grip, each cam being individually biased to an extended position spaced inwardly from the inner surface of the grip on which it is mounted and being individually movable toward the inner surface about its pivot axis in response to engagement of the cam against one transverse end of an elongated object, each cam having an inwardly facing surface for bearing against and engaging a solid transverse end of an elongated object.

2. The apparatus of claim 1 wherein each cam includes an inwardly facing frictional surface for engagement against one end of an object.

3. The apparatus of claim 1 wherein each cam is gravitationally biased to its extended position.

4. The apparatus of claim 1 wherein each cam is gravitationally biased to its extended position, each cam further including an inwardly facing frictional surface for engagement against one end of an object.

5. The apparatus of claim 1 wherein each cam is gravitationally biased to its extended position, each cam further including an inwardly facing frictional surface for engagement against one end of an object along an area located elevationally above the elevation of its axis.

6. The apparatus of claim 1, further comprising:

individual spring means operably connected between each cam and the grip on which it is mounted for yieldably biasing the individual cams to their extended positions.

7. The apparatus of claim 1 wherein the cams are spaced apart from one another along the length of the grip on which they are mounted by a repetitive center-to-center distance that is less than the width of the individual objects in a row as measured across their areas of engagement by the cams.

8. The apparatus of claim 1 wherein the cams are pivotally mounted on the grip about a common axis.

9. The apparatus of claim 1 wherein the cams are pivotally mounted on the grip about a common axis, the cams being spaced apart from one another along the length of the grip on which they are mounted by a repetitive center-to-center distance that is less than the width of the individual objects in a row as measured across their areas of engagement by the cams.

10. An apparatus for simultaneously grasping and lifting a plurality of elongated cylindrical metal billets having identical or slightly varying lengths and a common diameter and arranged side by side in a row, the elongated billets having transverse ends that are solid across their diameter, the apparatus comprising:

a pair of elongated grips positioned parallel to one another and mounted for relative motion toward or away from one another in a direction perpendicular to their lengths, the grips having opposed inner surfaces adapted to respectively face opposite transverse ends of the elongated billets; and the inner surface of at least one grip being provided with a plurality of identical cams pivotally mounted about a common axis on the grip with the cams being uniformly spaced apart along the length of the grip by a distance less than the common diameter of the billets, each cam being individually biased to an extended position spaced inwardly from the inner surface of the grip on which it is mounted and being individually movable toward the inner surface about its pivot axis in response to engagement of the cam against one transverse end of an elongated billet, each cam having an inwardly facing surface for bearing against and engaging a solid transverse end of an elongated billet.

11. The apparatus of claim 10 wherein the inner surface of the remaining grip is provided with a plurality of identical frictional surfaces that protrude inwardly from it in direct opposition to the individual cams.

12. The apparatus of claim 10 wherein the cams are spaced apart from one another along the length of the grip on which they are mounted by a repetitive center-to-center distance that is less than the minimum diameter of the individual billets to be engaged by them.

13. The apparatus of claim 10 wherein the cams are spaced apart from one another along the length of the grip on which they are mounted by a repetitive center-to-center distance that is one third of the minimum diameter of the individual billets to be engaged by them.

14. The apparatus of claim 10 wherein each cam includes an inwardly facing frictional surface for engagement against one end of an object.

15. The apparatus of claim 10 wherein each cam is gravitationally biased to its extended position.

16. The apparatus of claim 10 wherein each cam is gravitationally biased to its extended position, each cam further including an inwardly facing frictional surface for engagement against one end of an object.

17. The apparatus of claim 10 wherein each cam is gravitationally biased to its extended position, each cam further including an inwardly facing frictional surface for engagement against one end of an object along an area located elevationally above the elevation of its axis.

18. The apparatus of claim 10, further comprising:

individual spring means operably connected between each cam and the grip on which it is mounted for yieldably biasing the individual cams to their extended positions.

* * * * *